United States Patent [19]

Arai et al.

[11] Patent Number: 4,945,036

[45] Date of Patent: Jul. 31, 1990

[54] SILVER HALIDE PHOTOSENSITIVE MATERIAL

[75] Inventors: Naoki Arai; Kazuo Kagawa, both of Kanagawa, Japan

[73] Assignee: Fuji Photo Film Co., Ltd., Kanagawa, Japan

[21] Appl. No.: 359,304

[22] Filed: May 31, 1989

[30] Foreign Application Priority Data

May 31, 1988 [JP] Japan ..... 63-134096

[51] Int. Cl.[5] ..... G03C 1/18

[52] U.S. Cl. ..... 430/567; 430/568; 430/570; 430/571; 430/582; 430/583; 430/599; 430/966

[58] Field of Search ..... 430/567, 568, 570, 571, 430/582, 583, 599, 966

[56] References Cited

U.S. PATENT DOCUMENTS

| | | | |
|---|---|---|---|
| 3,941,595 | 3/1976 | Ranz et al. | 430/571 |
| 4,388,401 | 6/1983 | Hasebe et al. | 430/567 |
| 4,659,646 | 4/1987 | Inoue | 430/568 |
| 4,677,052 | 6/1987 | Inoue | 430/567 |
| 4,689,292 | 8/1987 | Metoki et al. | 430/570 |
| 4,746,593 | 5/1988 | Kitchin et al. | 430/567 |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

A silver halide photosensitive material is described, comprising two or more monodisperse silver halide emulsions of different average grain size on a support, wherein at least one of the said monodisperse silver halide emulsions has an average grain size of at least 0.7 μm, and at least one of the silver halide emulsions has a smaller average grain size than the other, the average grain size of the silver halide emulsion as a whole being within the range of from 0.33 to 0.54 μm, with a coated silver weight of from 2.3 to 3.8 g/m$^2$, and which contains a sensitizing dye represented by formula (I)

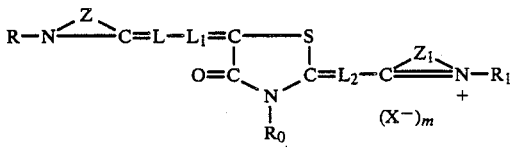

(I)

wherein Z and $Z_1$ each represents a group of non-metallic atoms forming a thiazole nucleus, a benzothiazole nucleus, or a benzoxazole nucleus; $R_0$ represents an alkyl group having from 1 to 6 carbon atoms, an allyl group, or an aralkyl group; R and $R_1$ each represents an alkyl group or an aryl group; L, $L_1$, and $L_2$ each represents a methine group; X represents an anion; and m represents 0 or 1, and an internal salt is formed when m is 0.

11 Claims, No Drawings

SILVER HALIDE PHOTOSENSITIVE MATERIAL

FIELD OF THE INVENTION

This invention concerns silver halide photosensitive materials, and especially silver halide photosensitive materials which are suitable for obtaining an image by means of a scanning exposure with a helium-neon laser and rapid development processing.

BACKGROUND OF THE INVENTION

In recent years images have been recorded by subjecting silver halide photosensitive materials to scanning exposures using laser light.

Laser light sources of various wavelengths (for example argon lasers, helium-neon lasers and semiconductor lasers) have been used in laser scanning exposure apparatus of this type, and appropriate silver halide photosensitive materials have been used in each type of apparatus. That is to say, the emulsion of a silver halide photosensitive material which is suitable for a certain type of laser light source is not always suitable for use with a different laser light source, changes having to be made with respect to the sensitizing dyes, and so the silver halide photosensitive materials which are used in exposing devices which have different laser light sources must generally differ in terms of emulsion design.

Conventionally, this method of recording has been used principally in the printing field, and so the silver halide photographic materials used have, in the main, achieved gradation by means of the size of screening dots, and they have been designed to give the best response when developed in a high contrast development bath. However, more recently, it has become desirable to reproduce continuous tone images, such as images for medical diagnostic purposes for example, using laser scanning exposures.

As an example, silver halide photosensitive materials for use with helium-neon laser light sources in which a coarse grained silver halide emulsion of average grain size from 0.5 to 1.0 μm is mixed with a fine grained silver halide emulsion of average grain size from 0.1 to 0.4. μm, and in which the film is hardened in such a way that the fusion time is greater than a fixed value, have been disclosed in JP-A-59-102229 (The term "JP A" as used herein signifies an "unexamined published Japanese patent application").

However, the silver halide photosensitive materials actually disclosed in JP-A-59-102229 have a disadvantage in that there is strong surface reflection therewith. Thus it is difficult to view the image, and since they have been designed in such a way as to be compatible with the normal processing (90 second processing) used for X ray photosensitive materials, there is a further disadvantage in that they cannot be subjected to rapid development processing (for example, with a time from the commencement of development, through fixing and washing to the completion of drying, within 75 seconds).

Furthermore, the use of a photosensor in which an LED which has a peak emission in the region of 950 nm is combined with a light receiving element is common in the above mentioned laser scanning exposure apparatus for detecting the position of the photosensitive material. However, silver halide photosensitive materials normally have virtually no absorption in the region of 950 nm when the grain size of the emulsion is small and the coated weight of silver is low (which is to say that the material does not have sufficient absorbance to enable the photosensor to detect the presence of the photosensitive material). Consequently, the inclusion of a dye which absorbs at this wavelength in the photosensitive material has been considered so that position detection can be carried out with such an LED. However, if these dyes are not washed out during processing and they are left behind in the photosensitive material they have an adverse effect when viewing the image. This means that an adequate washing process must be carried out in order to eliminate the residual coloration and this in turn means that rapid processing is more difficult to achieve.

SUMMARY OF THE INVENTION

This invention is intended to provide silver halide photosensitive materials for use with helium-neon laser light sources which can be subjected to rapid development processing, with which errors in position detection with a photosensor do not arise, and with which the surface reflection is slight so that the image viewing properties are good.

The aim of the invention has been realized by means of a silver halide photosensitive material comprising two or more monodisperse silver halide emulsions of different average grain size on a support wherein at least one of said monodisperse silver halide emulsions has an average grain size of at least 0.7 μm, and at least one of the silver halide emulsions has a smaller average grain size than the other, the average grain size of the silver halide emulsion as a whole being within the range of from 0.33 to 0.54 μm, with a coated silver weight of from 2.3 to 3.8 g/m$^2$, and which contains a sensitizing dye which can be represented by formula (I) below.

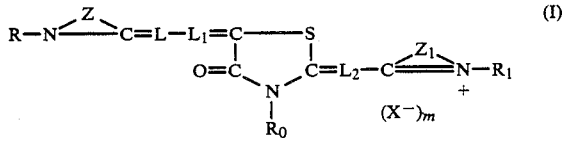

(I)

In formula (I), Z and $Z_1$ (which may be the same or different) each represents a group of non-metallic atoms forming a thiazole nucleus, a benzothiazole nucleus, or a benzoxazole nucleus. $R_0$ represents an alkyl group from 1 to 6 carbon atoms, an allyl group, or an aralkyl group. R and $R_1$ each represents an alkyl group or an aryl group. L, $L_1$, and $L_2$ each represents a methine group. Moreover, m represents 0 or 1, and an internal salt is formed when m is 0. X represents an anion.

DETAILED DESCRIPTION OF THE INVENTION

In this invention, the term "average grain size" signifies an average in diameter when the grains are spherical or nearly spherical, or in edge length when the grains are cubic, based on the projected area of the grains.

Further, the term "monodisperse emulsion" signifies an emulsion in which the grain size distribution has a variation coefficient ($S/\bar{r}$) for the grain size of the silver halide grains of not more than 0.25, and preferably of not more than 0.15. Here S is the standard deviation of the grain size. That is to say, if the grain size of each individual silver halide grain is $r_i$ and the number of grains is $n_i$, the average grain size is defined by the expression $\Sigma n_i r_i / \Sigma n_i$, and the standard deviation S is defined as the square root of the expression $\{\Sigma(\bar{r}-r_i) \cdot n_i\}/\Sigma n_i$.

In this invention, at least one type of monodisperse silver halide emulsion of average grain size of at least 0.7 μm and at least one monodisperse silver halide emulsion of average grain size of less than 0.7 μm are used conjointly.

The surface reflection of the processed photosensitive material is reduced by using a monodisperse silver halide emulsion of which the average grain size is at least 0.7 μm, and the materials are very suitable for image viewing. The use of one type of monodisperse silver halide emulsion having an average grain size of at least 0.7 μm is preferred. The amount used is preferably from 10 to 50%, and most desirably from 20 to 40%, based on the total coated silver weight of the whole of the silver halide emulsion.

It this invention at least one type of monodisperse silver halide emulsion of which the average grain size is less than 0.7 μm is used in addition to the above mentioned monodisperse silver halide emulsion of which the average grain size is at least 0.7 μm. This fine grained silver halide emulsion may consist of a single monodisperse silver halide emulsion or a mixture of two or more types of monodisperse silver halide emulsion. In either case, on drawing the grain size distribution curve for the silver halide emulsion, it is desirable that there should be a distinct dip between the peak which has the largest grain size of the peaks due to the silver halides of average grain size less than 0.7 μm and the peak due to the monodisperse silver halide emulsion having an average grain size at least 0.7 μm. Furthermore, a difference between these two peaks of not more than 0.3 μm is normally desirable.

The fine grained silver halide emulsion is used in an amount and with a grain size such that the average grain size of the silver halide emulsion as a whole is within the range of from 0.33 μm to 0.54 μm. This is done in order to obtain a characteristic curve which is suitable for the reproduction of continuous tone images, to enable the position of the photosensitive material to be detected by means of a photosensor and to maintain a suitable maximum image density. When the average grain size of the silver halide emulsion as a whole is less than 0.33 μm, interrupting or scattering effect on light of wavelength about 950 nm is weakened and the position of the photosensitive material cannot be detected using an LED. Furthermore, the maximum image density falls when the average silver halide grain size of the emulsion as a whole is greater than 0.54 μm.

On the other hand, the coated silver weight in this invention is within the range from 2.3 to 3.8 g/m$^2$, and if the coated silver weight exceeds 3.8 g/m$^2$, rapid processing becomes impossible and defects known as drag streaking are liable to occur (drag streaking is a phenomenon where upon developing the photosensitive material, the development of the parts adjoining parts which are developed strongly is inhibited, and the density is lower than that which should be developed). Furthermore, if the coated silver weight is less than 2.3 g/m$^2$, the interrupting or scattering effect on light of wavelength about 950 nm is reduced, and it becomes impossible to detect the position of the photosensitive material using an LED.

Furthermore, a sensitizing dye which can be represented by formula (I) is used in this invention. The dyes which have this specified structure do not have the adverse effect on rapid processing which is seen with other sensitizing dyes which absorb in the same wavelength region used in silver halide emulsions in which monodisperse grain emulsions with the specified grain size relationship of the invention as described above are mixed or laminated at the specified coated silver weight, and it has a desirable improving effect on the reciprocity law failure characteristics of the material.

In this invention, emulsions in which the ratio of (100) plane/(111) plane has a value of at least 1/1 and which contain from $10^{-8}$ to $10^{-5}$ mol of iridium ion per mol of silver are preferred. The iridium ion contents of the silver halide grains of different grain size may be the same or different. Preferably, the iridium content of the silver halide grains which have a small average grain size is the same as, or larger than, that of the silver halide grains which have a larger average grain size.

When, in this invention, two or more types of emulsion are coated in separate layers, the emulsion containing the silver halide grains which have the largest average grain size is preferably established on the side furthest from the support.

The values of the (100) plane/(111) plane ratios of the monodisperse silver halide emulsions used in the invention are at least 1/1, preferably at least 2/1, and most desirably at least 4/1. Furthermore, the upper limit of the above mentioned ratio is 100% (100) plane (i.e., ∞). If the value of the (100) plane/(111) plane ratio falls below 1/1, the photosensitivity achieved with the sensitizing dyes of formula (1) is inevitably reduced, and this is undesirable. Conversely, when the ratio has a value of 1/1 or more, the photosensitivity starts to be maintained at a high level and this is desirable.

Monodisperse silver halide grains of which the (100) plane/(111) plane ratio has a value of at least 1/1 which can be used in the invention can be prepared using various methods. The most general method is the so-called controlled double jet method in which an aqueous solution of silver nitrate and an aqueous solution of alkali metal halide are added simultaneously at a rate greater than the rate of dissolution of the grains selected so that no more nuclei formation takes place while maintaining the pAg at a fixed value below 8.10 during grain formation. The pAg value is preferably maintained below 7.80, and most desirably below 7.60. In those cases where silver halide grain formation can be divided into two separate processes, namely nuclei formation and grain growth, the pAg value during the growth phase in particular should be below 8.10, preferably below 7.80, and most desirably below 7.60. Furthermore, the system used to react the soluble silver salt with the soluble halide may involve a single sided mixing system, but simultaneous mixing methods are preferred for obtaining good monodisperse emulsions.

The silver halide emulsions used in the invention preferably include at least 50 wt%, preferably at least 60 wt%, and most desirably at least 80 wt%, of silver halide grains of which the value of the (100) plane/(111) plane ratio is at least 1/1, preferably at least 2/1, and most desirably at least 4/1.

The photosensitive silver halide used in the invention may be any silver halide consisting of chloride, bromide and/or iodide, such as silver bromide, silver iodobromide, silver chloride, silver chlorobromide, silver chloroiodide and silver chloroiodobromide for example, but silver bromide, silver iodobromide and silver chloroiodobromide are preferred. The iodide content of the silver halide is preferably from 0 to 20 mol %, and most desirably from 0 to 10 mol %. The silver chloride content of the silver halide is not more than 20 mol %, preferably not more than 10 mol % and most desirably not more than 5 mol %.

The silver halide grains preferably have a cubic form; however provided that the aforementioned plane index conditions are satisfied, they may have an irregular crystalline form, such as a pebble-like form, a spherical form, a plate-like form or a tabular form in which the grain diameter is at least five times the grain thickness (details have been disclosed, for example, in *Research Disclosure,* Item No. 22534, p. 58 (January 1983). These photosensitive emulsions may also be mixed with essentially non-photosensitive emulsions (for example, with fine grained emulsions which have been internally fogged). Of course, they may be coated in separate layers. The average grain size is preferably within the range from 0.1 to 2.0 μm.

Moreover, the crystal structure of the silver halide grains may be uniform into the interior of the grains, or the grains may have a layer structure in which the inner and outer part consist of different layers, or they may be of the so-called conversion type as disclosed in British Patent No. 635,841 or U.S. Pat. No. 3,622,318. Furthermore, they may be of the type with which the latent image is formed principally on the surface of the grains or of the type with which the latent image is formed principally within the grains.

The inclusion of iridium ions can be achieved by adding a water soluble iridium compound (for example, a hexachloroiridium(III) acid salt or a hexachloroiridium(IV) acid salt) in the form of an aqueous solution during the preparation of the silver halide emulsion. It can be added by inclusion in the same aqueous solution as the halide which is being used to form the grains or it may be added before grain formation, during grain formation or at any time after the grains have been formed prior to chemical sensitization. Most desirably, the addition is made during grain formation.

In this invention the use of from $10^{-8}$ to $10^{-5}$ mol of iridium ion per mol of silver halide is required, but the amount used is preferably from $5\times10^{7}$ to $5\times10^{-6}$ mol, and most desirably from $10^{-7}$ to $10^{-6}$ mol, per mol of silver halide.

If the amount of iridium ion used is less than $10^{-8}$ mol per mol of silver halide, there is a problem in that no improvement can be envisaged in respect of the exposure temperature dependence or on the progress of development and this is undesirable, while the inclusion of more than $10^{-5}$ mol per mol of silver halide is disadvantageous in that it causes desensitization in the infrared region, and this is also disadvantageous.

Silver halide solvents, such as ammonia, potassium thiocyanate, ammonium thiocyanate, thioether compounds (for example, those disclosed in U.S. Pat. Nos. 3,271,157, 3,574,628, 3,704,130, 4,297,439 and 4,276,374), thione compounds (for example those disclosed in JP-A-53-144319, JP-A-53-82408 and JP-A-55-77737), and amine compounds (for example those disclosed in JP-A-54-100717) can be used in order to control grain growth during the formation of the silver halide grains. In addition to these silver halide solvents, compounds which are adsorbed on the grain surfaces and control the crystal habit, such as cyanine based sensitizing dyes and tetraazaindene based compounds and mercapto compounds, can also be used during grain formation.

The value of the (100) plane/(111) plane ratio of the grains can be measured using the Kubelka-Munk dye adsorption method (referred to hereinafter as the Kubelka-Munk method). In this method, a dye which is adsorbed preferentially on either the (100) plane or the (111) plane and of which the optical spectrum differs depending on whether it is adsorbed on the (100) plane or the (111) plane is selected. The dye is added to the emulsion, and it is then possible to determine the value of the (100) plane/(111) plane ratio by investigating in detail the optical spectrum with respect to the amount of dye which has been added.

The precise proportion of (100) plane at the surface of the silver halide grains can be obtained using the method described by Tani in a paper entitled "The identification of the crystal phase of fine silver halide grains in photographic emulsions using dye adsorption phenomena" published in *Journal of The Chemical Society of Japan,* Vol. 6 pp. 942 to 946 (1984).

The silver halide emulsions can be chemically sensitized using the normal methods of chemical sensitization, for example by using gold sensitization (as disclosed, for example, in U.S. Pat. Nos. 2,540,085 and 2,399,083), by sensitization with group VIII metal ions (as disclosed, for example, in U.S. Pat. Nos. 2,448,060 and 2,598,079), by using sulfur sensitization (as disclosed, for example, in U.S. Pat. Nos. 1,574,944, 2,278,947, 3,021,215 and 3,635,717), by using reduction sensitization (as disclosed, for example, in U.S. Pat. No. 2,518,698 and Research Disclosure, Vol. 176, (December 1978), RD 17643, section III), by sensitization with thioether compounds (as disclosed, for example, in U.S. Pat. Nos. 2,521,926, 3,021,215, 3,046,133, 3,165,552, 3,625,697, 3,635,717 and 4,198,240) or by using a combination of these sensitization methods.

Actual examples of chemical sensitizers include sulfur sensitizers such as sodium thiosulfate, allyl thiocarbamide, thiourea, thiosulfate, thioethers and cystine; noble metal sensitizers such as potassium chloroaurate, aurousthiosulfate and potassium chloropalladate; and reduction sensitizers such as tin chloride, phenylhydrazine and reductone.

The sensitizing dyes of formula (I) used in the invention are described below.

Z and $Z_1$ in formula (I) each represents a group of non-melaIlic atoms forming a thiazole nucleus (for example, thiazole, 4-methylthiazole, 4-phenylthiazole, 4,5-dimethylthiazole and 4,5-diphenylthiazole), a benzothiazole nucleus (for example, benzothiazole, 5-chlorobenzothiazole, 6-chlorobenzothiazole, 5-methylbenzothiazole, 6-methylbenzothiazole, 5-bromobenzothiazole, 6-bromobenzothiazole, 5-iodobenzothiazole, 6-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiazole, 5-trifluoromethylbenzothiazole, 5,6-dimethylbenzothiazole, 5-hydroxy-6-methylbenzothiazole, 5-ethoxy-6-methylbenzothiazole and tetrahydrobenzothiazole) or a benzoxazole nucleus (for example, benzoxazole, 5-fluorobenzoxazole, 5-chlorobenzoxazole, 5-bromombenzoxazole, 5-trifluoromethylbenzoxazole, 5-methylbenzoxazole, 5-methyl-6-phenylbenzoxazole, 5,6,-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxazole and 5-hydroxybenzoxazole).

Most desirably, Z represents a group of nonmetallic atoms forming a thiazole nucleus and $Z_1$ represents a group of non-metallic atoms forming a benzothiazole nucleus.

The alkyl groups represented by R or $R_1$ in the above mentioned formula (I) are alkyl groups which have not more than 5 carbon atoms (for example, methyl, ethyl, n-propyl, n-butyl), substituted alkyl groups of which the alkyl radical has not more than 5 carbon atoms (for example, hydroxyalkyl groups [such as 2-hydroxyethyl, 3-hydroxypropyl, 4-hydroxybutyl], carboxyalkyl groups [such as carboxymethyl, 2-carboxyethyl, 3-carboxypropyl, 4-carboxybutyl, 2-(2-carboxyethoxy)-ethyl], sulfoalkyl groups [such as 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)propyl, 2-[(3-sulfopropoxy)ethoxy]ethyl, 2-hydroxy-3-(3'-sulfopropoxy)-propyl], aralkyl groups in which the alkyl radical preferably has from 1 to 5 carbon atoms and the aryl group is preferably a phenyl group [for example, benzyl, phenethyl, phenylpropyl, phenylbutyl, p-tolylpropyl, p-methoxyphenethyl, p-chlorophenethyl, p-carboxybenzyl, p-sulfophenethyl, p-sulfobenzyl], aryloxyalkyl groups (in which the alkyl radical preferably has from 1 to 5 carbon atoms and the aryl group of the aryloxy group is preferably a phenyl group [for example, phenoxyethyl, phenoxypropyl, phenoxybutyl, p-methylphenoxyethyl, p-methoxyphenoxypropyl], or vinylmethyl groups), and the aryl groups represented by R or $R_1$ are preferably phenyl groups. L, $L_1$ and $L_2$ represent methine groups or substituted methine groups, $$=\underset{\underset{R'}{|}}{C}-.$$

Here, R' is an alkyl group (for example, methyl, ethyl), a substituted alkyl group [for example an alkoxyalkyl group (such as 2-ethoxyethyl), a carboxyalkyl group (such as 2-carboxyethyl), an alkoxycarbonylalkyl group (such as 2-methoxycarbonylethyl) or an aralkyl group (such as benzyl, phenethyl)] or an aryl group [for example, phenyl, p-methoxyphenyl, p-chlorophenyl, o-carboxyphenyl]. Furthermore, L and R, and $L_2$ and $R_1$, may be joined together with methine groups to form nitrogen-containing heterocyclic rings.

$R_0$ may be an alkyl group (which preferably has from 1 to 6 carbon atoms, for example methyl, ethyl, propyl), an allyl group, or an aralkyl group (of which the alkyl radical preferably has from 1 to 5 carbon atoms, for example benzyl, p-carboxyphenylmethyl). The anion represented by X may be a halogen ion (iodide ion, bromide ion, chloride ion), a perchlorate ion, a thiocyanate ion, benzenesulfonate ion, p-toluenesulfonate ion, a methylsulfate ion or an ethylsulfate ion.

Actual examples of such dyes are indicated below.

I-1

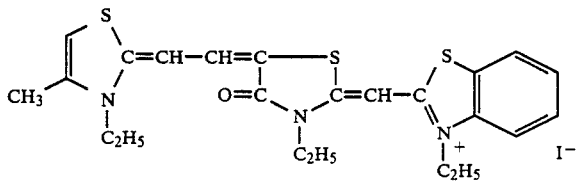

I-2

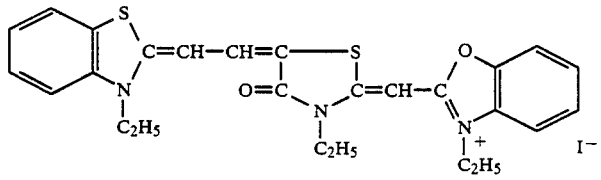

I-3

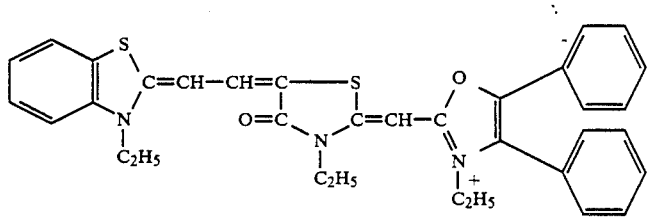

Various compounds can be added to the photographic materials of this invention with a view to reducing speed or preventing the occurrence of fogging during the manufacture, storage or photographic processing of the photosensitive material. These compounds include many heterocyclic compounds, such as nitrobenzimidazole, ammonium chloroplatinate, 4-hydroxy-6-methyl-1,3,3a,7-tetraazaindene, and 1-phenyl-5-mercaptotetrazole, and a great many compounds such as hydrated silver compounds, mercapto compounds and metal salts, all of which are well known. Examples of the compounds which can be used have been disclosed in the literature, e.g., on pages 344 to 249 of *The Theory of the Photographic Process* (third edition, 1966) by C. E. K. Mees, and include the thiazolium salts disclosed, for example, in U.S. Pat. Nos. 2,131,038 and 2,694,716; the azaindenes disclosed, for example, in U.S. Pat. Nos. 2,886,437 and 2,444,605; the urazoles disclosed in U.S. Pat. No. 3,287,135; the sulfocatechols disclosed, for example, in U.S. Pat. No. 3,236,625; the oximes disclosed, for example, in British Patent No. 623,448; the mercaptotetrazoles disclosed, for example, in U.S. Pat.

Nos. 2,403,927, 3,266,897 and 3,397,987; nitrone; nitroindazoles; the polyvalent metal salts disclosed, for example, in U.S. Pat. No. 2,839,405; the thiuronium salts disclosed, for example, in U.S. Pat. No. 3,220,839; and the palladium, platinum and gold salts disclosed, for example, in U.S. Pat. Nos. 2,566,263 and 2,597,915.

Developing agents, for example hydroquiones, catechols, aminophenols, 3-pyrazolidones, ascorbic acid and derivatives thereof, reductones and phenylenediamines, and combinations of these developing agents, can be included in silver halide photographic materials of this invention. The developing agents can be introduced into the silver halide emulsion layers and/or other photographic layers (for example protective layers, interlayers, filter layers, anti-halation layers and backing layers). The developing agents can be added in the form of a solution in an appropriate solvent or in the form of a dispersion, as disclosed in U.S. Pat. No. 2,592,368 and French Patent No. 1,505,778.

Organic compounds, such as methyl methacrylate homopolymers, methyl methacrylate/acrylic acid copolymers and starch, and inorganic compounds such as silica, titanium dioxide and strontium and barium sulfates, can be used in the form of fine particles as matting agents in this invention. The particle size here is from 1.0 to 10 μm, and preferably from 2 to 5 μm.

The silicone compounds disclosed, for example, in U.S. Pat. Nos. 3,489,576 and 4,047,958, and the colloidal silica disclosed in JP-B-No. 56-23139 can be used as slip agents in the surface layers of the photographic materials of this invention, and paraffin waxes, higher fatty acid esters and starch derivatives can also be used for this purpose (the term "JP-B" as used herein signifies an "examined Japanese patent publication"). Polyols, such as trimethylolpropane, pentanediol, butanediol, ethylene glycol and glycerine, can be used as plasticizers in the hydrophilic colloid layers of photographic materials of this invention.

Moreover, the inclusion of polymer latexes in the hydrophilic colloid layers of photographic materials of this invention is desirable for improving pressure resistance. The use of homopolymers of alkyl esters of acrylic acid or copolymers of these esters with acrylic acid, styrene/butadiene copolymers, and polymers and copolymers of monomers which have active methylene groups is preferred for these polymers.

Inorganic or organic film hardening agents can be included in the photographic emulsions and non-photosensitive hydrophilic colloids of this invention. Thus, aldehydes (for example, formaldehyde, glyoxal and glutaraldehyde), N-methylol compounds (for example, dimethylolurea and methyloldimethylhydantoin), dioxane derivatives (for example, 2,3-dihydroxydioxane), active vinyl compounds (for example, 1,3,5-triacryloylhexahydro-s-triazine, bis(vinylsulfonyl)methyl ether and N,N'-methylenebis-[β-(vinylsulfonyl)propionamide]), active halogen compounds (for example 2,4-dichloro-6-hydroxy-s-triazine), mucohalogenic acids (for example, mucochloric acid and mucophenoxychloric acid) can be used individually or in combinations for this purpose. From among these materials, the use of the active vinyl compounds disclosed in JP-A-No. 53-41220, JP-A-No. 53-57257, JP-A-No. 59-162546 and JP-A-No. 60-80846, and the active halogen compounds disclosed in U.S. Pat. No. 3,325,287 is preferred.

The silver halide photographic materials of this invention may have non-photosensitive layers, such as surface protective layers, interlayers and anti-halation layers, for example, as well as the photosensitive silver halide layers.

The silver halide emulsion layer may consist of two or more layers, and the photographic speed, gradation, etc., of these silver halide emulsion layers may be different. Furthermore, there may be one or more than one silver halide emulsion layer and non-photosensitive layer on both sides of the support.

Various surfactants can be included, for example as coating promoters, for antistatic purposes, for improving slip properties, for emulsification and dispersion purposes, or with a view to improving photographic performance (for example for accelerating development, increasing contrast or increasing photographic speed), in the photographic emulsion layers or other hydrophilic colloid layers of photosensitive materials made in accordance with this invention.

Surfactants which can be used in the invention have been disclosed, for example, by Oda in *Surfactants and their Applications* (Maki Shoten (1964)), by Horiguchi in *New Surfactants* (Sankyo Shuppan Co. (1975)) and in "McCutcheon's Detergents and Emulsifiers", (McCutcheon Divisions, MC Publishing Co., 1985) and in JP-A-No. 60-76741, JP-A-No. 62-172343, JP-A-No. 62-173459 and JP-A-62-215272.

The use of the fluorine-containing surfactants or polymers disclosed in U.S. Pat. No. 4,201,586, JP-A-No. 60-80849, JP-A-No. 59-74554, JP-A-No. 62-109044 and JP-A-No. 62-215272, the nonionic surfactants disclosed, for example, in JP-A-No. 60-76742, JP-A-No. 60-80846, JP-A-No. 60-80848, JP-A-No. 60-80839, JP-A-No. 60-76741, JP-A-No. 58-208743, JP-A-No. 62-172343, JP-A-No. 62-173459 and JP-A-No. 62-215272, or the electrically conductive polymers or latexes (nonionic, anionic, cationic and amphoteric) disclosed in JP-A-No. 57-204540 and JP A-62-215272 as antistatic agents is preferred. Furthermore, the use of ammonium, alkali metal, or alkaline earth metal halides, nitrates, perchlorates, sulfates, acetates, phosphates and thiocyanates for example, the electrically conductive tin and zinc oxides, and the complex oxides obtained by doping these metal oxides with antimony, as disclosed in JP-A-No. 57-118242 as inorganic anti-static agents is preferred. Moreover, various charge transfer complexes, conjugated π system polymers and doped substances, organometallic compounds and interlaminar compounds for example can also be used as antistatic agents, and examples include TCNQ-TTF, polyacetylene and polypyrrole. These have been described by Morita in *Science and Industry,* Vol. 59 (3), pp. 103 to 111 (1985}and ibid, Vol. 59 (4), pp. 146 to 152 (1985).

As well as gelatin, acylated gelatins such as phthalated gelatin and malonated gelatin; cellulose derivatives such as hydroxyethyl cellulose and carboxymethyl cellulose; soluble starches such as dextrin; and hydrophilic polymers such as poly(vinyl alcohol), polyvinylpyrrolidone, polyacrylamide and poly(styrenesulfonic acid), can be added as a protective colloid to the silver halide emulsion layers, interlayers, etc. used in the invention. From among these materials, the conjoint use of dextran and polyacrylamide together with gelatin is preferred.

Furthermore, polymer latexes consisting of homopolymers or copolymers of alkyl acrylates, alkyl methacrylates, acrylic acid, glycidyl acrylate etc. as disclosed, for example, in U.S. Pat. Nos. 3,411,911, 3,411,912, 3,142,568, 3,325,286 and 3,547,650, and JP-B-No.

45-5331, can be included with a view to improving the dimensional stability of the photographic materials and improving the properties of the films.

Plasticizers, fluorescent whiteners, anti-aerial fogging agents and color toners for example can also be included in the photographic emulsion layers and other hydrophilic colloid layers which are formed using this invention.

Color couplers, such as cyan couplers, magenta couplers and yellow couplers, and compounds which release couplers can be included in the silver halide photographic materials of this invention. That is to say, compounds which can form color by means of an oxidative coupling reaction with primary aromatic amine developing agents (for example phenylenediamine derivatives or aminophenol derivatives) during a color development process can be included. Those couplers, which are non-diffusible, having hydrophilic groups known as ballast groups within the molecule, are preferred. The couplers may be either four-equivalent or two-equivalent with respect to the silver ion. The couplers may also be colored couplers which have a color correcting effect, or couplers (so called DIR couplers) which release development inhibitors as development proceeds.

Furthermore, non-color forming DIR coupling compounds of which the products of the coupling reaction are colorless and which release a development inhibitor can also be included as well as the DIR couplers.

Colored images can also be formed by development in color development baths which contain diffusible couplers.

This invention can be used to increase the photographic speed of the silver halide emulsions which are used in black-and-white photographic emulsions, of course, and also of those which are used in various color photosensitive materials.

The use of polyethylene terephthalate films or cellulose triacetate films is preferred for the support, and these are preferably colored blue.

The surface of the support is preferably subjected to a coronal discharge treatment or a glow discharge treatment, or treated with ultraviolet radiation, in order to improve the adhesion of the hydrophilic colloid layer. Alternatively, a subbing layer of styrene/butadiene latex or vinylidene chloride based latex, for example, can be established on the support, and a layer of gelatin can be established over this layer.

Furthermore, one or more subbing layer can be established using an organic solvent which contains a polyethylene swelling agent and gelatin.

The subbing layers can also be subjected to a surface treatment to improve further the strength of adhesion to the hydrophilic colloid layer.

All of the known methods can be used for the photographic processing of photosensitive materials prepared in accordance with this invention. The known processing baths can also be used. A processing temperature is normally selected within the range from 18° C. to 50° C. All development processes in which a silver image is formed (black-and-white photographic processing) and color development processes in which development processing is carried out with a view to forming a dye image can be used, depending on the objective. More precisely, development processing can be achieved using the methods disclosed in *Research Disclosure,* Vol. 176, No. 17643, pages 28 to 29, and in *Research Disclosure,* Vol. 187, No. 18716, from the left hand column to the right hand column on page 651.

The inclusion of organic substances of the type which are washed out during development processing in the emulsion layers and/or other hydrophilic layers is desirable for the achievement of rapid processing in this invention. In cases where the substances which is washed out is a gelatin, the use of a type of gelatin which does not undergo a gelatin crosslinking reaction with film hardening agents is preferred. Examples of such gelatins include acetylated gelatins and phthalated gelatins, and the use of those gelatins which have a low molecular weight is preferred. On the other hand, polyacrylamides as disclosed in U.S. Pat. No. 3,271,158, and/or hydrophilic polymers such as poly(vinyl alcohol) and polyvinylpyrrolidone, for example, can be used effectively as polymeric substances other than gelatin, and sugars such as dextran, saccharose and pullulan are also effective for this purpose. From among these materials, polyacrylamide and dextran are preferred, and the use of polyacrylamide as such a substance is especially desirable. The average molecular weight of these substances is preferably not more than 20,000, and most desirably not more than 10,000.

The use of a combination of a dihydroxybenzene and a 1-phenyl-3-pyrazolone for the developing agent used in the black-and-white development baths used in the development processing of this invention is most desirable since such a combination facilitates the achievement of excellent performance. Of course, p-amino phenol based developing agents can also be included.

The dihydroxybenzene based developing agents which can be used in the invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone, but the use of hydroquinone is especially desirable.

The p-aminophenol based developing agents which can be used in the invention include N-methyl-p-aminophenol, p-aminophenol, N-(β-hydroxyethyl)-p-aminophenol, N-(4-hydroxyphenyl)glycine, 2-methyl-p-aminophenol, and p-benzylaminophenol and, of these, the use of N-methyl-p-aminophenol is preferred.

The 3-pyrazolidone based developing agents which can be used in the invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl 5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

Preferably, the developing agents are normally used at a concentration of from 0.01 to 1.2 mol/liter.

Sodium sulfite, potassium sulfite, lithium sulfite, ammonium sulfite, sodium bisulfite, and potassium metabisulfite, for example, can be used as sulfite preservatives in the development process in this invention. The sulfite is used at a concentration of at least 0.2 mol/liter, and preferably at a concentration of at least 0.4 mol/liter. Furthermore, an upper limit concentration of 2.5 mol/liter is desirable.

The pH of the development bath used for development processing in this invention is preferably within the range of from 9 to 13, and most desirably it is within the range of from 10 to 12.

pH adjusting agents such as sodium hydroxide, potassium hydroxide, sodium carbonate, potassium carbonate, sodium triphosphate and potassium triphosphate are included in the alkali which is used to determine the pH.

Use can also be made of the buffers disclosed in JP-A-No. 62-186259 (borates) or JP-A-No. 60-93433 (for example, saccharose, acetoxime, 5-sulfosalicylic acid), and phosphates and carbonates for example.

Furthermore, dialdehyde based film hardening agents or bisulfite addition compounds thereof can be used in the above mentioned development baths, and actual examples include glutaraldehyde and the bisulfite addition compound thereof.

Development inhibitors such sodium bromide, potassium bromide and potassium iodide, organic solvents such as ethylene glycol, diethylene glycol, triethylene glycol, dimethylformamide, methyl cellosolve, hexylene glycol, ethanol and methanol; and antifoggants including mercapto compounds such as 1-phenyl-5-mercaptotetrazole and sodium 2-mercaptobenzimidazole-5-sulfonate, indazole based compounds such as 5-nitroindazole, and benztriazole compounds such as 5-methylbenztriazole, can be included as additives which can be used in addition to the components described above, and toners, surfactants, anti-foaming agents, hard water softening agents and the amino compounds disclosed in JP-A-No. 56-106244, for example, can also be included, as required.

Anti-silver staining agents, for example the compounds disclosed in JP-A-No. 56-24347, can also be used in development and processing in this invention.

Amino compounds such as the alkanolamines disclosed in JP-A-No. 56-106244 can also be included in the development baths in this invention.

Those described by L. F. A. Mason in *Photographic Processing Chemistry,* pages 226 to 229 (published by Focal Press, 1966), and in U.S. Pat. Nos. 2,193,015 and 2,592,364, and JP-A-No. 48-64933, for example, can also be used.

The fixer bath is an aqueous solution which contains thiosulfates, and the pH is at least 3.8 and preferably from 4.2 to 7.0. A pH in the range from 4.5 to 5.5 is especially desirable.

Sodium thiosulfate or ammonium thiosulfate, for example, can be used as the fixing agent but the use of ammonium thiosulfate is preferred since it provides a faster fixing rate. The amount of fixing agent used can be varied appropriately but it is generally within the range from about 0.1 to about 6 mol/liter.

Water soluble aluminum salts which function as film hardening agents can be included in the fixing bath, and these salts include, for example, aluminum chloride, aluminum sulfate and potassium alum.

Tartaric acid, citric acid, gluconic acid and derivatives of these acids can be used individually, or two or more types can be used conjointly, in the fixing bath. These compounds are effective when included in an amount of at last 0.005 mol per liter of fixer bath, and they are particularly effective when included at a concentration of from 0.01 to 0.03 mol/liter.

Preservatives (for example, sulfites, bisulfites), pH buffers (for example, acetic acid, boric acid), pH adjusting agents (for example, sulfuric acid), chelating agents which have a hard water softening function and the compounds as disclosed in JP-A-No. 62-78551 can also included, as required, in the fixer bath.

The swelling factor of the photosensitive material is preferably small, as mentioned earlier, (preferably from 150% to 50%) and the process hardened film is preferably quite weak for rapid processing in this invention. That is to say, it is desirable that the film should not be hard during development and that it should not be hard during fixing, but the pH of the fixer bath may be set above 4.6 and a weak hardening reaction can be realized.

The method of development processing used with the above mentioned silver halide photographic materials involves treatment in a water washing bath or a stabilizing bath with a replenishment rate of not more than 3 liters (including zero for water washing) per square meter of the photosensitive material after the development and fixing processes.

That is to say, in the method of this invention not only is it possible to economize on water but it is also unnecessary to plumb automatic processing apparatus.

The multi-stage counter-flow system (with two or three stages for example) is well established as a method of minimizing the replenishment rate. If a multi-stage counter-flow system is applied to this invention, the fixed photosensitive material is processed by being brought into contact with a processing liquid which is not contaminated with fixing bath as it proceeds in the direction in which it becomes cleaner and so water washing is carried out very efficiently.

The application of an anti-fungal treatment to the water washing water or stabilizing bath is desirable in cases where economies are made in respect of the amount of water which is being used or when the automatic processor is not plumbed, as mentioned above.

The anti-fungal treatment may involve an ultraviolet irradiation procedure as disclosed in JP-A-No. 60-263939, the use of a magnetic field ad disclosed in JP-A-No. 60-263940, methods in which the water is purified using an ion exchange resin as disclosed in JP-A-No. 61-131632 or the use of a microbiocide as disclosed in JP-A-No. 62-115154, JP-A-No. 62-153952, JP-A-No. 62-220951 and JP-A-No. 62-209532.

Moreover, the microbiocides, biocides and surfactants etc. disclosed, for example, by L. E. West in "Water Quality Criteria", *Photo. Sci.* and Eng., Vol. 9, No. 6 (1965), by M. W. Beach in "Microbiological Growths in Motion Picture Processing", *SMPTE Journal,* Vol. 85, (1976), by R. O. Deegan in "Photo Processing Wash Water Biocides", *J. Imaging Tech.,* 10, No. 6 (1984), in JP-A-No. 57-8542, JP-A-No. 57-58143, JP-A-No. 58-105145, JP-A-No. 57-132146, JP-A-No. 58-18631, JP-A-No. 57-97530 and JP-A-No. 57-157244 can be used conjointly.

Moreover, the isothiazoline based compounds disclosed by R. T. Kreiman in *J. Image Tech.,* 10 (6), 242 (1984), the isothiazoline based compounds disclosed in *Research Disclosure,* (RD) Vol. 205, No. 20526 (May, 1981), the isothiazoline based compounds disclosed in *Research Disclosure,* Vol. 228, No. 22845 (April 1983) and the compounds disclosed in JP-A-No. 62-209532, for example, can be used conjointly as microbiocides in the water washing baths or stabilizing baths.

Compounds such as those disclosed by Horiguchi in *The Chemistry of Biocides and Fungicides,* published by Sankyo Shuppan (1982) and in *Biocide and Fungicide Technical Handbook* from the Japanese Biocide and Fungicide Association, published by Bakuhodo (1986) can also be included.

The establishment of squeeze roller washing tanks as disclosed in JP-A-No. 62-32460 is desirable when water washing with small amounts of water in the method of this invention.

Moreover, some or all of the overflow from a water washing or stabilizing bath produced as a result of the replenishment the water washing or stabilizing bath with water which has been subjected to an biocidal treatment as processing proceeds can be used, in this invention, in a processing bath which has a fixing function and which forms the stage prior to washing or stabilization, as disclosed in JP-A-No. 60-235133.

A distinguishing feature of the invention is that, when silver halide photosensitive materials of this invention are processed in an automatic processor with a procedure which includes at least the above mentioned stages of development, fixing, water washing (or stabilization) and drying, the whole process from development through to drying is completed within 75 seconds, which is to say that the time taken from the initial immersion of the leading edge of the photosensitive material into the development bath, passing through the fixing and water washing (or stabilization) processes and drying until the same leading edge emerges from the drying zone (the so-called dry to dry time) is within 75 seconds. Most desirably, the dry to dry time is within 70 seconds.

Such extremely rapid processing, which was not possible in the past, can be achieved effectively without adversely affecting other aspects of performance (image quality etc.) by using photosensitive materials in accordance with this invention.

In this invention, the term "development time" signifies the time from the immersion of the leading edge of the photosensitive material being processed in the development bath until it is immersed in the fixing bath which follows, the term "fixing time" signifies the time from immersion in the fixer tank solution until it is immersed in the water washing (stabilizing) bath in the tank which follows, and the term "water washing time" signifies the time for which the material is immersed in the water washing liquid.

Furthermore, the term "drying time" signifies the time for which the material is within the drying zone in an automatic processor in which there is established a drying zone which is normally heated by means of a current of hot air, normally at a temperature within the range from 35° C. to 100° C., and preferably within the range from 40° C. to 80° C.

The development temperature and time are preferably from about 25° C. to about 50° C. and from 6 seconds to 20 seconds, and most desirably from 30° C. to 40° C. and from 6 seconds to 15 seconds, in order to achieve rapid processing with a dry to dry time within 70 seconds of this invention.

As in the case of development, the fixing temperature and time are preferably from about 20° C. to about 50° C. and from 6 seconds to 20 seconds, and most desirably from 30° C. to 40° C. and from 6 seconds to 15 seconds.

The water washing or stabilizing bath temperature and time are preferably from about 0° C. to about 50° C. and from 6 seconds to 20 seconds, and most desirably from 15° C. to 40° C. and from 6 seconds to 15 seconds.

According to this invention, the water washing water is preferably removed from the photographic materials which have been developed, fixed and washed (or stabilized), which is to say they are preferably passed through a squeeze roller, and dried. Drying is carried out at a temperature of from about 40° C. to about 100° C., and the drying temperature can be varied appropriately depending on the ambient conditions, but normally a drying time of from about 5 seconds to about 30 seconds is preferred, and, most desirably, drying is carried out for a period of from about 5 seconds to about 20 seconds at a temperature within the range from 40° C. to 80° C.

No particular limit is imposed on the photographic material in the method of development processing of photosensitive materials of this invention but it is applied principally to black-and-white photosensitive materials in general. However, it can also be used with color photosensitive materials. The use of the invention with photographic materials for use with laser printers for medical images and with scanner sensitive materials for printing purposes, for example, is especially desirable.

An example of the invention is described below, but the invention is not limited thereby.

EXAMPLE 1

(1) Preparation of Monodisperse Silver Halide Emulsions of this Invention

A suitable amount of ammonia was introduced into a container which contained gelatin, potassium bromide and water which had been heated to 55° C., after which an aqueous solution of silver nitrate and an aqueous solution of potassium bromide to which a salt of hexachloroiridium(III) acid had been added so that the mol ratio of iridium with respect to the silver was $10^{-7}$ were added thereto using a double jet method to prepare monodisperse silver bromide grain emulsions of which the average grain size was 0.75, 0.4 and 0.25 μm respectively. Furthermore, potassium iodide was added at the rate of $1\times10^{-3}$ mol per mol of silver during the latter stages of grain formation. These emulsified grains were such that 98% of all the grains (by number) had a grain size within ±40% of the average grain size. The emulsions were then desalted, after which the pH was adjusted to 6.2 and the pAg was adjusted to 8.6, and then gold/sulfur sensitization was carried out using sodium thiosulfate and chloroauric acid, an aqueous solution of 4-hydroxy-6-methyl-1,3,3a,7-tetraazaindene was added as a chemical sensitization terminator and the prescribed photographic characteristics were obtained. These emulsions are referred to hereinafter as emulsions A, B and C respectively.

(2) Preparation of the Emulsion Coating Liquids

Total weights of 1000 grams of the emulsion A, B and C in varying proportions as described hereinafter were weighed out and mixed together and heated to 40° C. in a container to form a solution, after which 130 cc of a methanolic solution (0.1%) of the sensitizing dye I-1 indicated previously, 20 cc of a methanolic solution (2%) of the supersensitizer 4,4'-bis[2,6-di(2-naphthoxy)-pyrimidin-4-ylamino]stilbenzene-2,2'-disulfonic acid, 30 cc of a methanolic solution (0.8%) of the stabilizer indicated below, 5 cc of an aqueous solution (50%) of trimethylolpropane, an aqueous solution of 4-hydroxy-6-methyl-1,3,3a,7-tetraazaindene, an aqueous solution of, as a coating promoter, a dodecylbenzenesulfonate, an aqueous solution of polyacrylamide and an aqueous solution of a viscosity increasing agent, poly(potassium p-vinylbenzenesulfonate), were added and coating liquids were obtained.

Thus, after weighing out 334 grams of emulsion A, 333 grams of emulsion B and 333 grams of emulsion C and forming a solution, additives were added in accordance with the formulation described above to provide emulsion coating liquid (i).

After weighing out 567 grams of emulsion A, 333 grams of emulsion B and 100 grams of emulsion C and forming a solution, additives were added in accordance with the formulation described above to provide emulsion coating liquid (ii).

After weighing out 334 grams of emulsion A, 333 grams of emulsion B and 333 grams of emulsion C and forming a solution, additives were added in accordance with the formulation described above except that the sensitizing dye II-1 indicated below was used to provide emulsion coating liquid (iii).

After weighing out 600 grams of emulsion B and 400 grams of emulsion C and forming a solution, additives were added in accordance with the formulation described above to provide emulsion coating liquid (iv).

The two emulsions indicated in sample 2 of Example 1 of JP-A-No. 59-102229 were used as emulsion D (r=0.6 μm, monodispersed) and emulsion E (r=0.28 μm, monodispersed) and, after weighing out 910 grams of emulsion D and 90 grams of emulsion E and forming a solution, additives were added in accordance with the formulation described above to provide emulsion coating liquid (v).

II-1

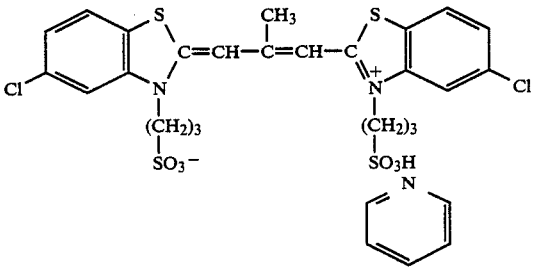

Stabilizer

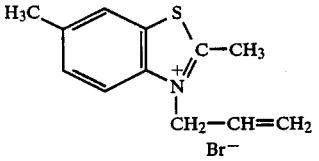

(3) Preparation of the Coating Liquid for the Surface Protective Layer of the Photosensitive Layer An aqueous solution of viscosity imparting agent (sodium polystyrenesulfonate), a matting agent (fine particles of poly(methyl methacrylate), average particle size 3.0 μm), film hardening agent (N,N'-ethylenebis(-vinylsulfonylacetamide), coating promoter (sodium t-octylphenoxyethoxyethanesulfonate) and, as an antistatic agent, an aqueous solution of the polyethylene based surfactants of which the structures are indicated below, an aqueous solution of a fluorine based compound of which the structure is indicated below, and an aqueous solution of polyacrylamide and poly(acrylic acid) were added to a 10 wt. % aqueous solution of gelatin which had been heated to 40° C. to provide a coating liquid.

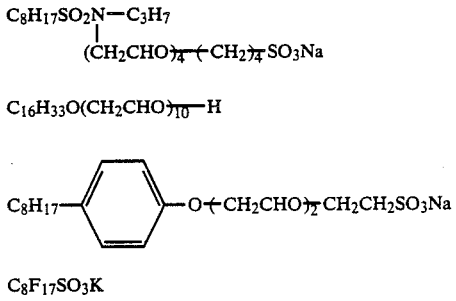

(4) Preparation of the Backing Layer Coating Liquid

An aqueous solution of a viscosity imparting agent (sodium polyethylenesulfonate), 400 cc of a aqueous solution (6%) of the dye indicated below, an aqueous solution of film hardening agent (N,N'-ethylenebis(-vinylsulfonylacetamide), an aqueous solution of coating promoter (sodium t-octylphenoxyethoxyethanesulfonate) and an aqueous solution of a copolymer of methyl methacrylate and ethyl acrylate were added to 1 kg of a 10 wt. % aqueous gelatin solution which had been heated to 40° C. to provide a coating liquid.

Dye

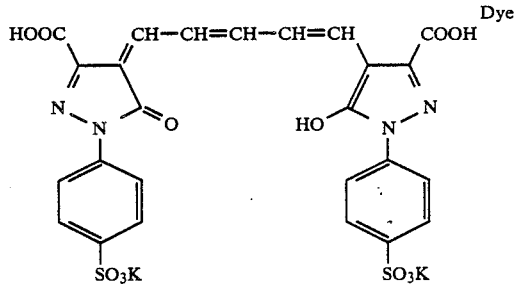

(5) Preparation of the Coating Liquid for the Surface Protective Layer for the Backing Layer A matting agent (fine particles of poly(methyl methacrylate), average particle size 3.0 μm), an aqueous solution of coating promoter (sodium t-octylphenoxyethoxyethanesulfonate), an aqueous solution of the polyethylene based surfactants of which the structures are indicated below as antistatic agents:

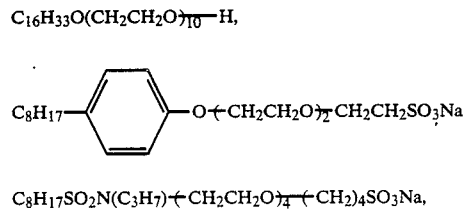

and an aqueous solution of the fluorine containing compound of which the structure is indicated below were added to a 10 wt. % aqueous gelatin solution which had been heated to 40° C. to provide a coating liquid.

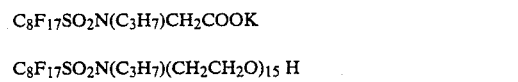

(6) Preparation Of Coated Samples

The backing layer coating liquid was coated along with the coating liquid for the surface protective layer for the backing layer onto one side of a polyethylene terephthalate support to provide a coated gelatin weight of 4 g/m$^2$. Next, the emulsion coating liquid containing the sensitizing dyes described in (2) above and the coating liquid for the surface protective layer therefor were coated on the other side of the support with varying coated silver weights.

The coated material with a coated silver weight of 3.2 g/m$^2$ of the emulsion coating liquid (i) was sample (a) and the coated material with a coated silver weight of 3.2 g/m$^2$ of the emulsion coating liquid (ii) was sample (b). The coated material with a coated silver weight of 4.2 g/m$^2$ of the emulsion coating liquid (ii) was sample (c). Furthermore, the coated material with a coated silver weight of 2.3 g/m$^2$ of the emulsion coating liquid (ii) was sample (d). The coated material with a coated silver weight of 3.2 g/m$^2$ of the emulsion coating liquid (iii) was sample (e). The coated material with a coated silver weight of 2 g/m$^2$ of the emulsion coating liquid (iv) was sample (f), and the coated material with a coated silver weight of 4 g/m$^2$ of the emulsion coating liquid (v) was sample (g).

(7) Development Processing

The various samples prepared in (6) were stored under conditions of 20° C., 65% RH, and on the seventh day after coating they were subjected to scanning exposures of varying intensity using a helium-neon laser of wavelength 633 nm at room temperature. The exposed samples were developed and processed using the stages and procedure indicated below in an automatic processing machine.

The compositions of the development bath and the fixer bath were as indicated below.

| | |
|---|---|
| Development Bath | |
| Sodium hydroxide | 24 grams |
| Sodium sulfite | 40 grams |
| Potassium sulfite | 50 grams |
| Diethylenetriaminepentaacetic acid | 2.4 grams |
| Boric acid | 10 grams |
| Hydroquinone | 35 grams |
| Diethylene glycol | 11.2 grams |
| 4-Hydroxymethyl-4-methyl-1-phenyl-3-pyrazolidone | 1.7 grams |
| 5-Methylbenzotriazole | 0.06 gram |
| Potassium bromide | 2 grams |
| Water to make up to (pH adjusted to 10.5) | 1 liter |
| Fixer Bath | |
| Ammonium thiosulfate | 140 grams |
| Sodium sulfite | 15 grams |
| Disodium ethylenediaminetetra-acetate (dihydrate) | 0.025 gram |
| Sodium hydroxide | 6 grams |
| Water to make up to (pH adjusted to 5.10 with acetic acid) | 1 liter |
| Water Washing Bath | |
| Disodium ethylenediaminetetra-acetate (dihydrate) | 0.5 g/liter |

Processing was carried out in 70 seconds from the commencement of development to the completion of drying with the automatic processor. The transporting speed was 28 mm/second.

Development Tank: 7.5 liters, 35° C.×11.5 seconds
Fixer Tank: 7.5 liters, 35° C.×12.5 seconds
Water Wash Tank: 6.0 liters, 20° C.×7.5 seconds
Drying: 50° C.

(8) Evaluation of Suitability for Rapid Processing $D_{max}$ was obtained from the sensitometry carried out in (7). A value of $D_{max}$ of over 2.90 was assessed as , a $D_{max}$ value of from 2.90 to 2.64 was assessed as Δ and a $D_{max}$ of less than 2.64 was assessed as x. Furthermore, residual coloration was assessed on the basis of the color of the unexposed parts after processing, and those which were satisfactory were assessed as while those which were unsatisfactory were assessed as x.

(9) Evaluation of Emulsion Surface Surface Reflection After Processing

An image was phantom copied, and with the emulsion surface of the processed film facing the front, the film was placed on a lamp for diagnostic purposes. A ceiling fluorescent lamp was directed onto the emulsion surface and those cases in which diagnosis was impeded were classified as x while those where there was no such impediment were classified as 0.

(10) Testing the Possibility of Film Position Detection with an Infrared Diode

A photo-interrupter in which an LED which had a peak emission wavelength of about 950 nm, a sensor which received the light and the required electronic circuit were combined as a whole (a GP/A/7 Sharp Photointerrupter, made by the Sharp Co., LED—sensor distance 10 mm) was used. Film samples were inserted between the sensor and the LED of the photo-interrupter and whether or not the device switched ON and OFF (detecting the presence or otherwise of the film) in a stable manner when the film was or was not present was evaluated. Cases in which no erroneous operation occurred on repeating the detection of film test were classified as , and cases in which the presence of the film could not be detected were classified as x.

The results obtained were as shown in Table 1.

It is clear from Table 1 that only the combinations in accordance this invention were suitable for rapid processing, had good surface reflection properties after processing, and could be detected using an LED.

TABLE 1

| Sample | Mixing Ratio of the Emulsions A | B | C | D | E | Ave. Grain Size of Silver Halide Overall (μ) | Coated Ag Weight (mg/m$^2$) | Sensitizing Dye | Suitability for Rapid Processing $D_{max}$ | Residual Color | Surface Reflection of Emulsion after Processing | Position Detection with LED |
|---|---|---|---|---|---|---|---|---|---|---|---|---|
| (a) | 334 | 333 | 333 | — | — | 0.47 | 3.2 | I-1 | O | O | O | O |
| (b) | 567 | 333 | 100 | — | — | 0.58 | 3.2 | I-1 | X | O | O | O |
| (c) | 334 | 333 | 333 | — | — | 0.47 | 4.2 | I-1 | O | X | O | O |
| (d) | 334 | 333 | 333 | — | — | 0.47 | 2.3 | I-1 | Δ | O | O | O |

TABLE 1-continued

| Sample | Mixing Ratio of the Emulsions A | B | C | D | E | Ave. Grain Size of Silver Halide Overall (μ) | Coated Ag Weight (mg/m²) | Sensitizing Dye | Suitability for Rapid Processing $D_{max}$ | Residual Color | Surface Reflection of Emulsion after Processing | Position Detection with LED |
|---|---|---|---|---|---|---|---|---|---|---|---|---|
| (e) | 334 | 333 | 333 | — | — | 0.47 | 3.2 | II-1 | O | X | O | O |
| (f) | — | 600 | 400 | — | — | 0.34 | 3.2 | I-1 | O | O | X | X |
| (g)* | — | — | — | 910 | 90 | 0.57 | 4 | I-1 | Δ | X | X | O |

*Sample 2 of example 1 of JP-A-59-102229
Emulsion A: r = 0.75 μ, Monodispersed,
B: r = 0.4 μ, Monodispersed,
C: r = 0.25 μ, Monodispersed
Emulsion D: r = 0.6 μ, Monodispersed
Emulsion E: r = 0.28 μ, Monodispersed While the invention has been described in detail and with reference to specific embodiments thereof, it will be apparent to one skilled in the art that various changes and modifications can be made therein without departing from the spirit and scope thereof.

What is claimed is:

1. A silver halide photosensitive material comprising two or more monodisperse silver halide emulsions of different average grain size on a support, wherein at least one of said monodisperse silver halide emulsions has an average grain size of at least 0.7 μm, and at least one of the silver halide emulsions has a smaller average grain size than the other, the average grain size of the silver halide emulsion as a whole being within the range of from 0.33 to 0.54 μm, with a coated silver weight of from 2.3 to 3.8 g/m², and which contains a sensitizing dye represented by formula (I)

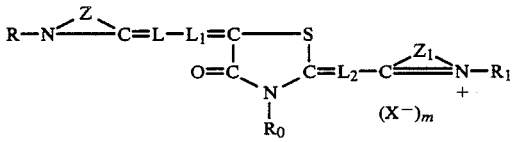

(I)

wherein Z and $Z_1$ each represents a group of non-metallic atoms forming a thiazole nucleus, a benzothiazole nucleus, or a benzoxazole nucleus; $R_0$ represents an alkyl group having from 1 to 6 carbon atoms, an allyl group, or an aralkyl group; R and $R_1$ each represents an alkyl group or an aryl group; L, $L_1$, and $L_2$ each represents a methine group; X represents an anion; and m represents 0 or 1, and an internal salt is formed when m is 0.

2. A silver halide photosensitive material as in claim 1, wherein said monodisperse silver halide emulsion having an average grain size of at least 0.7 μm is present in an amount of from 10 to 50%, based on the total coated silver weight of the whole of the silver halide emulsion.

3. A silver halide photosensitive material as in claim 1, wherein said monodisperse silver halide emulsion having an average grain size of at least 0.7 μm is present in an amount of from 20 to 40%, based on the total coated silver weight of the whole of the silver halide emulsion.

4. A silver halide photosensitive material as in claim 1, wherein the monodisperse silver halide emulsions have a ratio of (100) plane/(111) plane of a value of at least 1/1 and contain from $10^{-8}$ to $10^{-5}$ mol of iridium ion per mol of silver.

5. A silver halide photosensitive material as in claim 4, wherein the ratio of (100) plane/(111) plane has a value of at least 2/1.

6. A silver halide photosensitive material as in claim 4, wherein the ratio of (100) plane/(111) plane has a value of at least 4/1.

7. A silver halide photosensitive material as in claim 4, wherein the ratio of (100) plane/(111) plane has a value of ∞.

8. A silver halide photosensitive material as in claim 4, wherein at least 50 weight % of said silver halide grains have said ratio.

9. A silver halide photosensitive material as in claim 5, wherein at least 60 weight % of said silver halide grains have said ratio.

10. A silver halide photosensitive material as in claim 6, wherein at least 80 weight % of said silver halide grains have said ratio.

11. A method for processing a silver halide photosensitive material in an automatic processor with a procedure which includes at least development, fixing, water washing or stabilization and drying, said silver halide photosensitive material being a silver halide photosensitive material comprising two or more monodisperse silver halide emulsions of different average grain size on a support, wherein at least one of said monodisperse silver halide emulsions has an average grain size of at least 0.7 μm, and at least one of the silver halide emulsions has a smaller average grain size than the other, the average grain size of the silver halide emulsion as a whole being within the range of from 0.33 to 0.54 μm, with a coated silver weight of from 2.3 to 3.8 g/m², and which contains a sensitizing dye represented by formula (I)

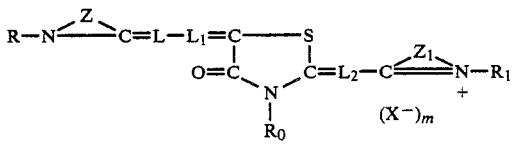

(I)

wherein Z and $Z_1$ each represents a group of non-metallic atoms forming a thiazole nucleus, a benzothiazole nucleus, or a benzoxazole nucleus; $R_0$ represents an alkyl group having from 1 to 6 carbon atoms, an allyl group, or an aralkyl group; R and $R_1$ each represents an alkyl group or an aryl group; L, $L_1$, and $L_2$ each represents a methine group; X represents an anion; and m represents 0 or 1, and an internal salt is formed when m is 0, wherein the whole process from the development through to the drying is completed within 75 seconds.

* * * * *